United States Patent [19]

Tanabe

[11] 4,331,855

[45] May 25, 1982

[54] GAS SENSOR OUTPUT/TIMER OUTPUT CONTROLLED COOKING UTENSIL

[75] Inventor: Takeshi Tanabe, Higashiosaka, Japan

[73] Assignee: Sharp Kabushiki Kaisha, Osaka, Japan

[21] Appl. No.: 123,647

[22] Filed: Feb. 22, 1980

[30] Foreign Application Priority Data

Feb. 23, 1979 [JP] Japan ..... 54-21060

[51] Int. Cl.[3] ..... H05B 9/06

[52] U.S. Cl. ..... 219/10.55 B; 219/10.55 R; 200/5 R; 340/632; 340/588

[58] Field of Search ..... 219/10.55 B, 10.55 F, 219/10.55 R, 492, 497, 494, 493; 126/19 R; 340/602, 588, 584; 200/5 R

[56] References Cited

U.S. PATENT DOCUMENTS

| | | | |
|---|---|---|---|
| 2,942,221 | 6/1960 | Girolamo | 200/5 R |
| 3,012,116 | 12/1961 | Boylan et al. | 200/5 R |
| 3,028,472 | 4/1962 | Baird | 219/10.55B |
| 3,839,616 | 10/1974 | Risman | 219/10.55 R |
| 4,109,129 | 8/1978 | Satoh et al. | 219/10.55B |
| 4,133,995 | 1/1979 | Buck | 219/10.55 B |
| 4,162,381 | 7/1979 | Buck | 219/10.55 B |
| 4,181,744 | 1/1980 | Buck | 219/10.55 R |
| 4,188,510 | 2/1980 | Dills | 219/10.55 B |

FOREIGN PATENT DOCUMENTS

| | | | |
|---|---|---|---|
| 2744878 | 4/1978 | Fed. Rep. of Germany | 219/10.55 B |
| 2753405 | 6/1978 | Fed. Rep. of Germany | 219/10.55 B |
| 52-5033 | 1/1977 | Japan | 219/10.55 B |
| 52-5035 | 1/1977 | Japan | 219/10.55 B |
| 52-13150 | 2/1977 | Japan | 219/10.55 B |
| 52-47703 | 3/1977 | Japan | 219/10.55 B |
| 52-61850 | 5/1977 | Japan | 219/10.55 B |
| 54-2541 | 1/1979 | Japan | 219/10.55 B |
| 2002143 | 2/1979 | United Kingdom | 219/10.55 B |

*Primary Examiner*—B. A. Reynolds
*Assistant Examiner*—M. H. Paschall
*Attorney, Agent, or Firm*—Birch, Stewart, Kolasch & Birch

[57] ABSTRACT

A combined microwave and electric heating oven includes a gas sensor for detecting a completion of the cooking operation, and a timer for determining a cooking time period. A selection lever is slidably secured on a control panel for selecting a desired gas concentration value at which the cooking operation should be automatically terminated. First switches are disposed at both ends of the sliding course of the selection lever for placing the combined microwave and electric heating oven in a timer controlled operation mode instead of a gas sensor output controlled automatic cooking operation mode when the selection lever is located either end of the sliding course. A second switch is disposed at a preselected position in the sliding course for selecting the electric heating cooking when the selection lever is located at the preselected position.

6 Claims, 5 Drawing Figures

GAS SENSOR OUTPUT/TIMER OUTPUT CONTROLLED COOKING UTENSIL

BACKGROUND AND SUMMARY OF THE INVENTION

The present invention relates to a cooking utensil which includes a gas sensor for automatic cooking control purposes.

A microwave oven is proposed in my copending application Ser. No. 71,179, "COOKING UTENSIL CONTROLLED BY GAS SENSOR OUTPUT", filed on Aug. 31, 1979, wherein a gas sensor is disposed in an exhaustion duct for detecting a gas concentration developed from an oven cavity. When the gas concentration reaches a preselected value, the gas sensor output shows a preselected value, and in response thereto the microwave generation is terminated.

To achieve the automatically controlled cooking operation, the preselected value should be varied in response to the kind of foodstuff to be cooked. In addition to the automatic cooking operation controlled by the gas sensor output, it is preferable that the conventional timer controlled cooking operation be performed for a specific kind of cooking.

Accordingly, an object of the present invention is to provide a novel selection system in a cooking utensil for selecting a desired operation mode of cooking.

Another object of the present invention is to provide a cooking mode selection system of a simple construction and ensuring easy handling.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

To achieve the above objects, pursuant to an embodiment of the present invention, a slidable lever is provided on a control panel of a cooking utensil, for example, a microwave oven for selecting a desired cooking menu. In response to the selected cooking menu, a reference level, which is compared with an output voltage signal derived from a gas sensor, is varied to perform the automatic cooking control. When the slidable lever is slided to the end of the predetermined course of movement, the control circuit is placed in another mode of operation, wherein the cooking operation is controlled by an output signal derived from a timer.

BRIEF DESCRIPTION OF THE DRAWINGS

The present invention will be better understood from the detailed description given hereinbelow and the accompanying drawings which are given by way of illustration only, and thus are not limitative of the present invention and wherein.

DESCRIPTION OF THE PREFERRED EMBODIMENTS

Figure 1:
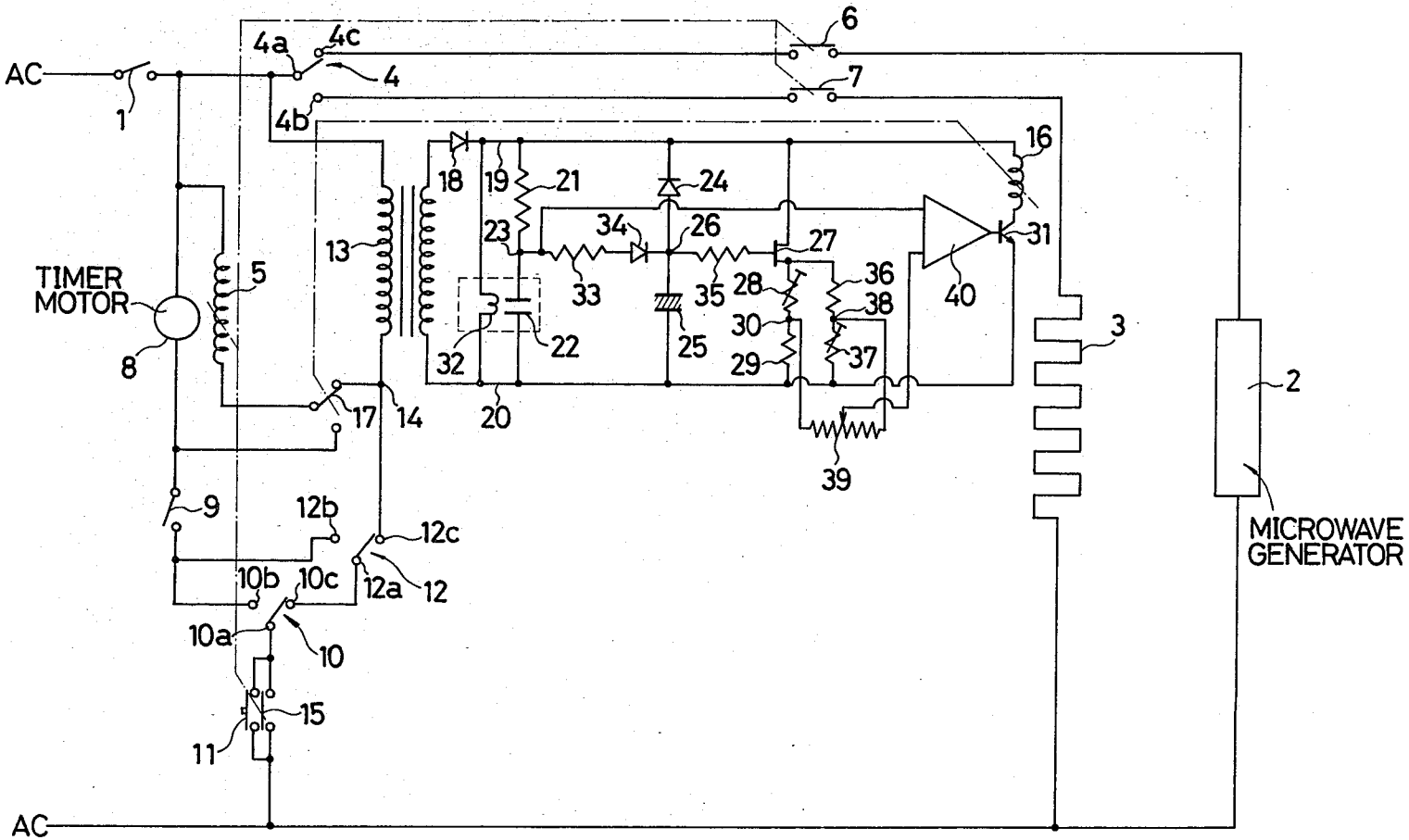
FIG. 1 is a circuit diagram of a control circuit of an embodiment of a cooking utensil of the present invention.

FIG. 1 shows an embodiment of a control circuit of a cooking utensil of the present invention.

The control circuit mainly comprises a door switch 1 which is closed when an oven door of the cooking utensil is closed, a microwave generator 2 such as a magnetron and the driver circuit thereof, a heater 3 for electric heating cooking purposes, and a selection switch 4. The microwave generator 2 is connected to receive an A.C. power supply through the door switch 1, the selection switch 4 and a normally open relay contact 6 which is closed by a relay coil 5. The heater 3 is connected to receive the A.C. power supply through the door switch 1, the selection switch 4 and a normally open relay contact 7 which is closed by a relay coil 5.

The control circuit further comprises a timer motor 8, a selection switch 10, and a cook start manual switch 11. The timer motor 8 is connected to the A.C. power source through the door switch 1, a timer contact 9, a normally open terminal **10*b* of the selection switch 10, and the cook start manual switch 11. A normally closed terminal 10*c* of the selection switch 10 is connected to a primary winding of a transformer 13 via a normally close terminal 12*c* of another selection switch 12. A series circuit of the relay coil 5 and a normally close terminal of a relay contact 17, which is activated by a relay coil 16, is connected to the timer motor 8 in a parallel fashion. A normally open terminal of the relay contact 17 is connected to a node 14 of the transformer 13 and the normally close terminal 12*c* of the selection switch 12. The normally open terminal 10*b* of the selection switch 10 is connected to a normally open terminal 12*b* of the selection switch 12. And, a normally open relay contact 15, which is closed by the relay coil 5, is connected with the cook start switch 11** in a parallel fashion.

A diode 18 is connected to the secondary winding of the transformer 13 to provide a positive voltage terminal 19 and a negative voltage terminal 20. A series circuit of a resistor 21 and a gas sensor 22 is disposed between the positive voltage terminal 19 and the negative voltage terminal 20. A series circuit of an inversely connected diode 24 and a capacitor 25 is also disposed between the positive voltage terminal 19 and the negative voltage terminal 20. And, a series circuit of an anode-cathode path of a field effect transistor 27, a variable resistor 28 and a resistor 29 is also disposed between the terminals 19 and 20. Further, a series circuit of the relay coil 16 and a collector-emitter path of a transistor 31 is disposed between the terminals 19 and 20. A warming heater 32 for the gas sensor 22 is also connected to receive the power supply via the terminals 19 and 20.

A node 23 of the resistor 21 and the gas sensor 22 is connected to a node 26 of the diode 24 and the capacitor 25 through a resistor 33 and a diode 34. The node 26 is connected to the gate electrode of the field effect transistor 27 via a resistor 35. A series circuit of a resistor 36 and a variable resistor 37 is connected to the series circuit of the variable resistor 28 and the resistor 29 in a parallel fashion. A node 30 of the variable resistor 28 and the resistor 29 is connected to a node 38 of the resistor 36 and the variable resistor 37 through a volume resistor 39. A variable output terminal of the volume resistor 39 is connected to a reference voltage input terminal of a comparator 40. An output terminal of the comparator 40 is connected to the base electrode of the transistor 31. The node 23 is connected to a data input terminal of the comparator 40.

Figure 2:
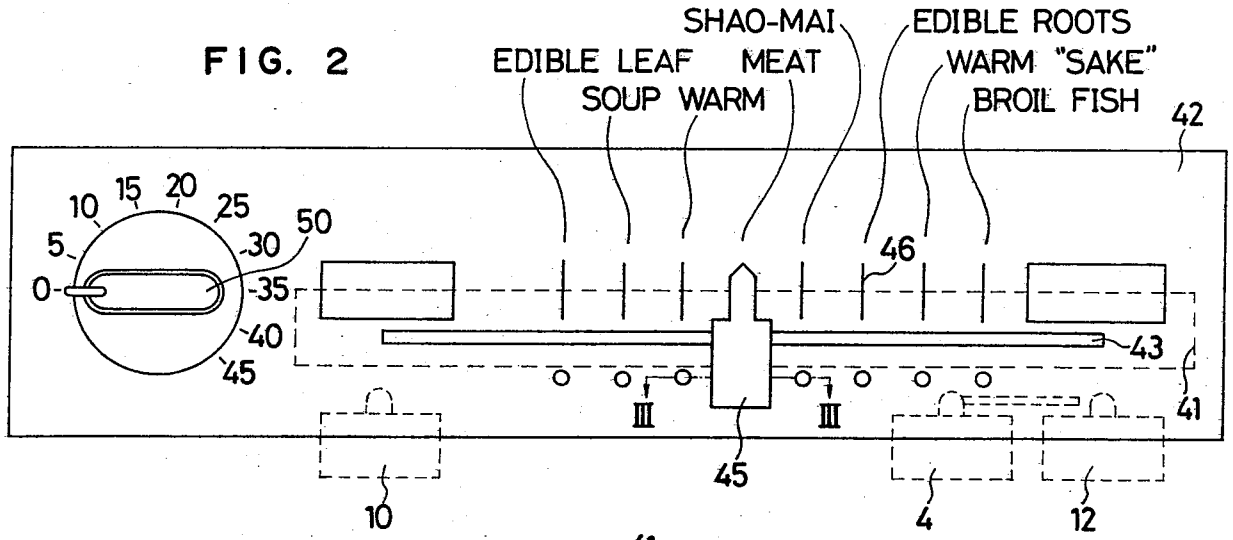
FIG. 2 is a schematic front view of a cooking mode selection panel included in the cooking utensil of FIG. 1.
Figure 3:
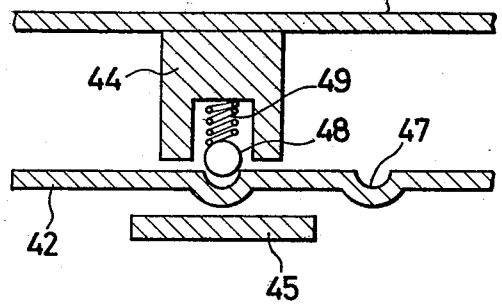
FIG. 3 is a sectional view taken along line III—III of FIG. 2.

The above-mentioned volume resistor 39, and the selection switches 4, 10 and 12 are correlated with each other as shown in FIGS. 2 and 3.

A resistor plate 41, on which a carbon film is coated, is provided for the volume resistor means. A control panel 42 is disposed in front of the resistor plate 41. The control panel 42 is provided with a slit 43 in which a lever 45 is slidably secured. A slidable member 44, which is fixed to the lever 45 through the slit 43, is disposed between the resistor plate 41 and the control panel 42 in such a manner that one end of the slidable member 44 contacts the resistor plate 41. Indications 46 are provided on the control panel 42 for selecting a desired cooking mode of operation in accordance with the kind of foodstuff to be cooked. Click stop indents 47 are formed on the control panel 42 for temporarily holding the slidable member 44 at a desired position in the course of the sliding movement. A click ball 48 is secured to the slidable member 44 via a spring 49, the click ball 48 being associated with the click stop indents 47.

Figure 4:
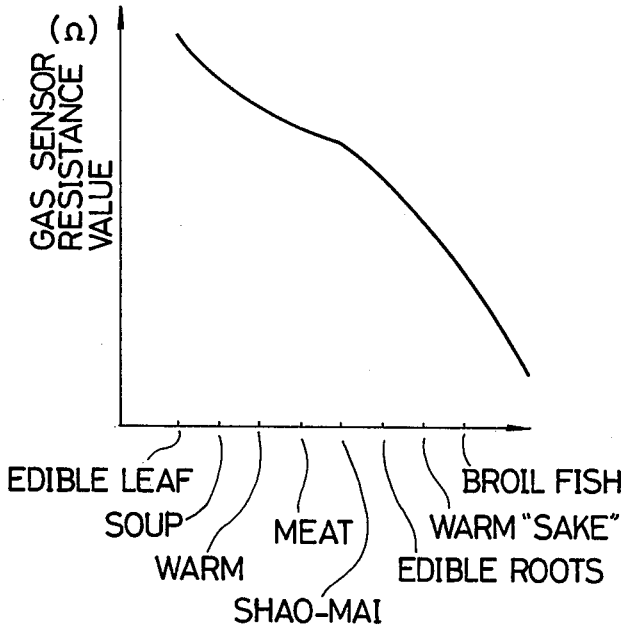
FIG. 4 is a graph showing a resistance value of a gas sensor at which the cooking operation should be terminated depending on the kind of foodstuff to be cooked.

The slidable member 44 functions to determine the reference voltage level to be applied to the comparator 40. More specifically, the indicators 46 are aligned in the order of the kind of foodstuff of which the preferred cooking operation be completed at preselected gas concentrations which gradually increases (the resistance value of the gas sensor 22 gradually decreases). In this example, the kind of foodstuff to be selected is aligned rightward in the order of EDIBLE LEAF, SOUP, REWARM, MEAT, SHAO-MAI, EDIBLE ROOTS, WARM "SAKE", and BROIL FISH. FIG. 4 shows the resistance value of the gas sensor 22 at which the cooking operation should be completed depending on the kind of foodstuff to be cooked.

Figure 5:
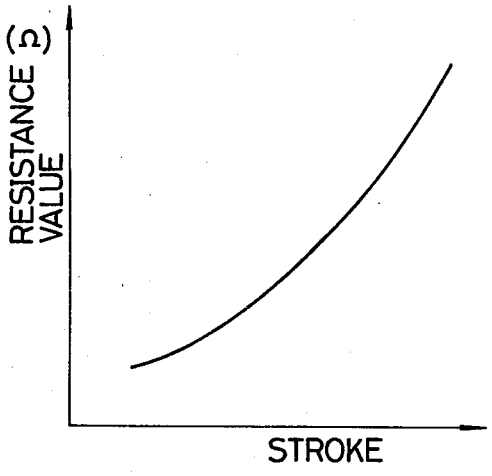
FIG. 5 is a graph showing resistance value of a volume resistor versus selection lever stroke characteristics of the cooking mode selection panel of FIG. 2.

FIG. 5 shows the variation of the resistance value of the volume resistor 39 depending on the stroke distance of the slidable member 44 from the left end of the sliding course.

The selection switch 10 is positioned at the left end of the slidable movement of the slidable member 44, and the selection switch 12 is positioned at the right end of the slidable movement of the slidable member 44. The selection switch 4 is positioned near the location of the indicator 46 for the "BROIL FISH".

Movable terminals 4*a*, 10*a* and 12*a* of the selection switches 4, 10 and 12 are normally connected to a normally close terminal 4*c* and the normally close terminals 10*c* and 12*c*, respectively. When the slidable member 44 contacts the movable terminals 4*a*, 10*a* or 12*a*, the movable contacts are made contact with the normally open terminals 4*b*, 10*b* and 12*b*, respectively. The selection switch 4 is constructed so that the movable terminal 4*a* is made contact with the normally open terminal 4*b* when the slidable lever 45 is positioned right than the indication 46 for the "BROIL FISH ".

When the oven door is closed after disposing the foodstuff within the oven cavity, the door switch 1 is closed. Then, the selection lever 45, which is associated with the volume resistor 39, is slided to select a desired reference voltage level to be applied to the comparator 40 in accordance with the kind of foodstuff to be cooked. Under these conditions when the cook start switch 11 is actuated, the microwave generator 2 or the heater 3 is energized for cooking purposes.

Now assume that the "MEAT" cooking is desired to be performed. The slidable lever 45 is held at the indication 46 for "MEAT", and the reference voltage signal suited for the "MEAT" cooking is applied to the reference voltage input terminal of the comparator 40 from the volume resistor 39. Since the slidable member 44 does not contact any one of the movable terminals of the selection switches 4, 10 and 12, the movable terminals 4*a*, 10*a* and 12*a* are made contact with the normally close terminals 4*c*, 10*c* and 12*c*, respectively. Accordingly, the microwave generator 2 is supplied with power through the normally open relay contact 6, which is closed by the relay coil 5. The transformer 13 also receives the power supply and, therefore, the gas sensor detection circuit is enabled.

At the moment shortly after the actuation of the cook start switch 11, the gas concentration is considerably low and, hence, the relay coil 16 receives the power supply. The relay contact 17 is inclined toward the normally open terminal and, therefore, the relay coil 5 is energized to close the relay contacts 6, 7 and 15. When the cooking operation is performed to a desired level determined by the volume resistor 39, the data signal derived from the gas sensor 22 shows the same value as the reference voltage signal and, therefore, the comparator 40 develops a detection output to turn off the transistor 31. The relay coil 16 is deenergized, whereby the relay contact 17 is connected to the normally close terminal. Accordingly, the relay coil 5 is deenergized to open the relay contacts 6, 7 and 15, thereby completing the cooking operation.

When the timer controlled cooking operation is desired to be performed instead of the gas sensor output controlled automatic cooking operation, the slidable lever 45 is slided either end of the sliding course to make contact with the movable terminal of the selection switch 10 or 12, with the normally open terminal. A timer lever 50 is winded to set a desired cooking time period. The timer contact 9 is closed, and the relay coil 5 is energized through the normally close terminal of the relay contact 17 upon actuation of the cook start switch 11. Accordingly, the relay contacts 6, 7 and 15 are closed to activate the microwave generator 2 or the heater 3 until the preselected time period has been counted by the timer motor 8.

When the slidable lever 45 is positioned at the indication of the "BROIL FISH", the movable terminal 4*a* of the selection switch 4 is made contact with the normally open terminal 4*b*, whereby the heater 3 is energized. The capacitor 25 is provided for compensating for the initial condition of the cooking operation when the cooking operation is sequentially conducted with a short time interval.

The invention being thus described, it will be obvious that the same may be varied in many ways. Such variations are not to be regarded as a departure from the spirit and scope of the invention, and all such modifications are intended to be included within the scope of the following claims.

What is claimed is:

1. In a cooking utensil for cooking a foodstuff including a timer, a gas sensor for detecting the concentration of a gas emitted from said foodstuff and for developing an output in response thereto, said gas including reducing gases, said gas sensor detecting the concentration of said reducing gases emitted from said foodstuff, and manual selection means for selecting a desired cooking condition for said foodstuff when said selection means is placed in one of a plurality of desired positions, said selection means being disposed on a control panel, said control panel comprising:

volume resistor means responsive to the selection of said desired cooking condition by said selection means for determining a desired reference signal, said reference signal being compared with said output from said gas sensor for controlling said cooking utensil; and first switch means responsive to the placement of said selection means at a preselected position other than said desired positions for enabling said timer and disabling said gas sensor thereby removing said cooking utensil from a gas sensor controlled cooking operation mode and placing said cooking utensil in a timer controlled cooking operation mode.

2. The cooking utensil of claim 1, wherein said selection means is slidably secured on said control panel, and said first switch means is disposed at an end of the slidable course of the selection means.

3. The cooking utensil of claim 1 or 2, wherein said cooking utensil comprises a cooking energy source, said cooking energy source including a microwave generation source for developing microwave energy for cooking purposes and an electric heater for developing electric heat energy for cooking purposes.

4. The cooking utensil of claim 3, further comprising second switch means for automatically selecting either the microwave generation source or the electric heater in response to the location of said selection means.

5. A cooking utensil for cooking a foodstuff, comprising:

a cooking energy source developing means;

gas sensor means for detecting the concentration of a gas emitted from said foodstuff and developing an output signal in response thereto thereby controlling the operation of said cooking utensil in a gas sensor controlled cooking operation mode, said gas including reducing gases, said gas sensor detecting the concentration of said reducing gases emitted from said foodstuff;

manual selection means for selecting a desired cooking condition for said foodstuff when said selection means is placed in one of a plurality of desired positions;

volume resistor means responsive to the selection of said desired cooking condition by said selection means for determining a reference signal level;

comparator means responsive to the output from said gas sensor and to said reference signal from said volume resistor means for developing a resultant output when the output from said gas sensor exceeds said reference signal level; and controlling means responsive to said resultant output for controlling the energization of said cooking energy source developing means.

6. A cooking utensil in accordance with claim 5, further comprising a timer for controlling the operation of said cooking utensil in a timer controlled cooking operation mode; and switch means responsive to the placement of said selection means at a preselected position other than said desired positions for enabling said timer and disabling said gas sensor in response thereto, said controlling means energizing said cooking energy source developing means for a time period determined by said timer during the enablement thereof.

* * * * *